United States Patent [19]

Fleming

[11] 4,392,037

[45] Jul. 5, 1983

[54] STABILIZED BUTTON FOR AN ELECTRICAL KEYBOARD

[75] Inventor: Anthony Fleming, Glasgow, Scotland

[73] Assignee: Burroughs Corporation, Detroit, Mich.

[21] Appl. No.: 270,689

[22] Filed: Jun. 4, 1981

[30] Foreign Application Priority Data

Jun. 7, 1980 [GB] United Kingdom ..... 8018745

[51] Int. Cl.[3] ..... H01H 13/00

[52] U.S. Cl. ..... 200/340; 200/159 R; 248/500

[58] Field of Search ..... 200/340, 159 B, 159 R; 248/499, 500, 505, 680, 681

[56] References Cited

U.S. PATENT DOCUMENTS

| | | | |
|---|---|---|---|
| 3,047,700 | 7/1962 | Bailey | 200/340 |
| 3,157,771 | 11/1964 | Roeser | 200/159 R |
| 3,780,237 | 12/1973 | Seeger, Jr. et al. | 200/340 X |
| 4,132,877 | 1/1979 | Daigle | 200/159 R X |

FOREIGN PATENT DOCUMENTS 1510260 12/1976 United Kingdom .

OTHER PUBLICATIONS

Harris, R. H., *Counterweight Space Bar Mechanism,* Sep. 1977, IBM Technical Disclosure Bulletin-vol. 20, No. 4, pp. 1536-1537.

Harris, R. H. *Self-Biasing Space Bar Stabilizer Mechanism,* Feb. 1979, IBM Technical Disclosure Bulletin-vol. 21, No. 9, pp. 3725-3726.

*Primary Examiner*—John W. Shepperd
*Assistant Examiner*—Renee Kidorf
*Attorney, Agent, or Firm*—D. G. Rasmussen; K. R. Peterson; E. M. Chung

[57] ABSTRACT

A large area button in an electrical keyboard is prevented from jamming by being stabilized against tilt which results from depressive forces being applied remotely from the center of the button, the stabilization being achieved by the provision of two anti-roll bars attaching the button to the body of the keyboard and each preventing deviation of one of two axes of the button from being orthogonal both to one another and to the direction of depression of the button.

7 Claims, 2 Drawing Figures

STABILIZED BUTTON FOR AN ELECTRICAL KEYBOARD

BACKGROUND TO THE INVENTION

1. Field of the Invention

The present invention relates to a button for use in an electrical keyboard, and particularly relates to such a button which is prevented from tilting.

2. The Prior Art

It is well known to employ depressible, spring restored buttons for operating electrical switching devices in electrical keyboards. Keyboard ergonomics make it advantageous to provide buttons, in any one keyboard, whose size is considerably larger than the average size of button in that keyboard.

Electrical keyboard buttons are generally affixed to depression-sensitive switching devices, such as microswitches, by means of sleeves, collars, edge guides and the like. Large area buttons are subject to depressive forces applied remotely from their centers and causing considerable torque thereabout, providing a likelihood of jamming in the collars, sleeves or guides. Torque-induced tilt and jamming is usually limited, but not eliminated, at some expense, by the provision of plural suspension points beneath the button, usually in the form of additional parallel-connected switching devices. It is therefore desirable from an economic, mechanical and aesthetic point of view to provide a large area electrical keyboard button where torque-induced tilt is substantially eliminated, so that only one switching device is required therebeneath, the risk of jamming is substantially eliminated, and the button has a stability satisfying to the user.

SUMMARY OF THE INVENTION

According to the present invention there is provided a button for use in an electrical keyboard comprising a depressible pad and a plurality of stabilizers for coupling said pad to said keyboard such that each one of said plurality of stabilizers acts to maintain one out of a corresponding plurality of axes of said pad orthogonal to the direction of motion of said pad irrespectively of the extent of depression of said pad.

BRIEF DESCRIPTION OF THE PREFERRED EMBODIMENT

In a preferred embodiment a large molded plastic L-shaped zero pad in a numerical keyboard is provided with two anti-roll bars made from stiff steel wire which are affixed, orthogonally to one another, both to the pad and to the keyboard and in co-operatively maintaining two mutually othogonal axes of the pad orthogonal to the direction of motion of the pad, maintain the attitude of the pad irrespectively of its extent of depression.

The present invention is further explained by way of an example, by the following description together with the appended drawings;

DETAILED DESCRIPTION OF THE PREFERRED EMBODIMENT

Figure 1:
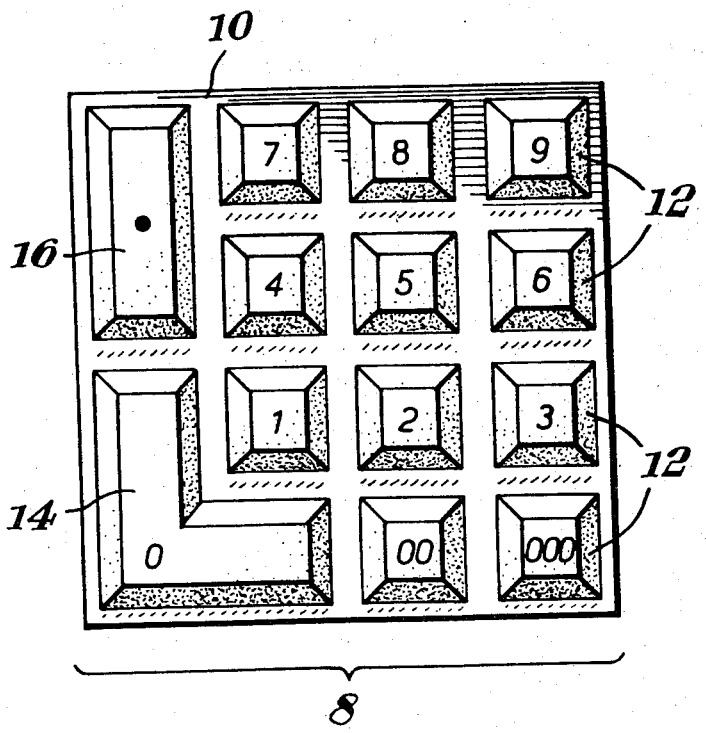
FIG. 1 shows the keyboard of which the button is a part.

FIG. 1 shows a numerical keyboard 8, for example a sub-keyboard in the control console of a data processor.

A face panel 10 has protruding therethrough eleven small buttons 12 intended for finger operation, a large corner zero button 14 intended for thumb operation and a large decimal point key 16 also intended for thumb operation.

Each of the buttons 12, 14, 16 is disposed above its own individual microswitch and affixed thereto by a collar or any other means already known in the art. When a button 12, 14, 16 is depressed, its associated microswitch makes or breaks an electrical circuit unique to that button. When button 12, 14, 16 is released, a spring in its associated microswitch restores the button to its previous, undepressed position.

The small buttons 12 are sufficiently small to be substantially free from tilt, and they are therefore not stabilized. The corner zero key 14 and the decimal point key 16 are both large enough to suffer from tilting and jamming, and they are therefore both stabilized.

Figure 2:
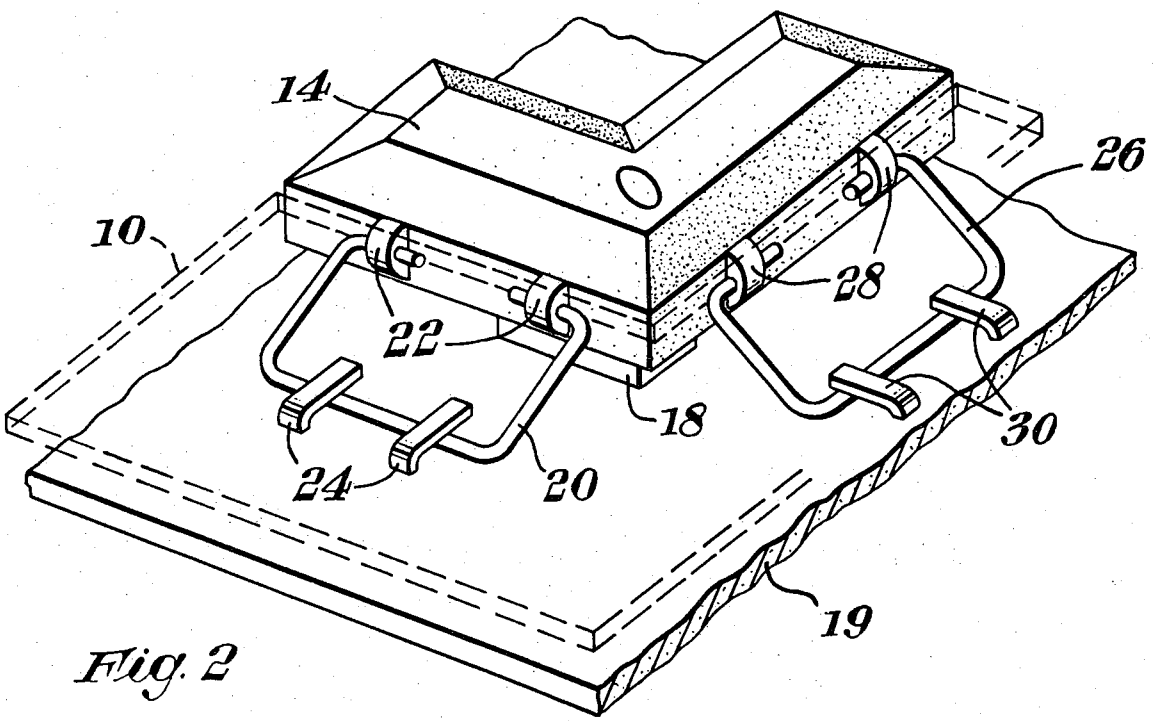
FIG. 2 shows details of the buttons mounting in the keyboard.

FIG. 2 shows the corner zero button 14 and the apparatus associated therewith to stabilize it against tilt.

A microswitch 18, affixed to a base board 19 is centrally disposed beneath the button 14. The base board 19 is parallel planar to and disposed beneath the face panel 10 which is shown in phantom.

A first anti-roll bar 20, a stiff, steel wire form, is affixed to a first side of the button 14 by two first lugs 22. The lugs 22 are situated on a first line orthogonal to the direction of depression of the button 14. The bar 20 passes through the lugs 22 with a close but sliding fit. The bar 20 is held onto the base board 19 by two first tabs 24 which allow the bar 20 to slide to and fro therebeneath, but do not allow it to tilt out of the plane of the board.

A second anti-roll bar 26 is affixed to the button 14 in precisely the same manner as the first anti-roll bar 20 by second lugs 28 and to the board 19, again in precisely the same manner as for the first anti-roll 20, by second tabs 30, the second anti-roll bar 26 being on a second side of the button 14 normal to the first side of the button 14.

As the button 14 is depressed, it is prevented from transverse movement by the microswitch 18; the first anti-roll bar 20 maintains its particular stabilized axis orthogonal to the button trajectory and the second anti-roll bar 26 maintains its particular stabilized axis orthogonal to the button trajectory. Since the two axes are also orthogonal to one another, the button 14 is maintained with its face permanently normal to the direction of depression.

As the button 14 descends, the anti-roll bars 20,26 slide beneath the tabs 24, 30 to accommodate the decreasing distance between the lugs 22, 28 and the tabs 24, 30.

It will be apparent to those skilled in the art that the tabs might equally well be accommodated on the face board 10. It will also be apparent that other stabilizers might equally well be used in place of the anti-roll bars, for example a plate, hinged onto the button and passing through a slot assembly on the base board or the face board. It will further be apparent that the anti-roll bars or other stabilizers are not required to be at ninety degrees to one another, simply to be non-parallel to one another in order that the button should be stabilized. It will lastly be apparent that more than two stabilizers may be simultaneously so used.

The decimal point button 16 is stabilized in precisely the same manner, having a long anti-roll bar for its long side and a short anti-roll bar for its short side.

What is claimed is:

1. A keyboard with depressable keys mounted on a base, the keyboard having apparatus for stabilizing the movement of the keys along the axes orthogonal to the direction of depression of the keys comprising:

one or more rigid members, each said member movably secured at multiple points to said key and movably secured at multiple points to said base, said multiple securing points for said key and said base being along lines maintaining a parallel relation with one of said axis orthogonal to the direction of key depression, said secured rigid members stabilizing movement of said keys along the axes.

2. The apparatus of claim 1 having multiple rigid members stabilizing movement along axes which are non-parallel.

3. The apparatus of claim 2 in which said rigid member is pivotably secured to said key so as to maintain a parallel relation between the line of multiple securing points of said rigid member on said key and one of said axis.

4. The apparatus of claim 3 in which said rigid member is slidably secured to said base so as to maintain a parallel relation between the line of multiple securing points of said rigid member on said base and one of said axis.

5. The apparatus of claim 4 in which said rigid member is a frame defining a planar figure.

6. The apparatus of claim 5 in which said frame is a wire.

7. The apparatus of claim 6 in which said rigid member is secured to said base by one or more tabs placing one side of said rigid wire member against said base to make sliding contact therewith, the contact line being parallel with one of said axis.

* * * * *